US011549786B2

(12) United States Patent
Flynn

(10) Patent No.: US 11,549,786 B2
(45) Date of Patent: Jan. 10, 2023

(54) MULTI-SIDED TARGET ASSEMBLY

(71) Applicant: Timothy J. Flynn, Key Largo, FL (US)

(72) Inventor: Timothy J. Flynn, Key Largo, FL (US)

( * ) Notice: Subject to any disclaimer, the term of this patent is extended or adjusted under 35 U.S.C. 154(b) by 503 days.

(21) Appl. No.: 16/118,853

(22) Filed: Aug. 31, 2018

(65) Prior Publication Data

US 2018/0372457 A1 Dec. 27, 2018

Related U.S. Application Data

(63) Continuation of application No. 15/054,411, filed on Feb. 26, 2016, now Pat. No. 10,101,133.

(51) Int. Cl.

| | |
|---|---|
| ***F41J 1/10*** | (2006.01) |
| ***F41J 1/01*** | (2006.01) |
| ***F41J 7/04*** | (2006.01) |

(52) U.S. Cl.

CPC . *F41J 1/10* (2013.01); *F41J 1/01* (2013.01); *F41J 7/04* (2013.01)

(58) Field of Classification Search

CPC .. B65D 5/42; A47G 33/12; A63F 1/10; A63B 55/10

See application file for complete search history.

(56) References Cited

U.S. PATENT DOCUMENTS

| | | | | |
|---|---|---|---|---|
| 1,145,585 | A | | 7/1915 | Hebard |
| 1,723,826 | A | | 8/1929 | Van Auken |
| 1,825,292 | A | | 9/1931 | Van Auken |
| 2,771,260 | A | * | 11/1956 | Thom ..... A47G 33/12 248/524 |
| 3,330,561 | A | | 7/1967 | Kandel |
| 3,353,827 | A | | 11/1967 | Dun, Jr. |
| 3,370,852 | A | | 2/1968 | Kandel |
| 3,423,092 | A | | 1/1969 | Kandel |
| 3,895,803 | A | | 7/1975 | Loe |
| 3,899,175 | A | | 8/1975 | Loe |
| 4,066,261 | A | | 1/1978 | Stewart |
| 4,462,598 | A | | 7/1984 | Chalin et al. |
| 4,498,677 | A | | 2/1985 | Dapkus |
| 4,877,932 | A | * | 10/1989 | Bernstein ..... B65D 81/3453 426/243 |
| 4,919,421 | A | * | 4/1990 | Vandeveld ..... A63B 47/025 473/494 |
| 4,921,256 | A | | 5/1990 | Gearhart |
| 5,029,797 | A | * | 7/1991 | Levorchick ..... A63F 1/10 248/459 |
| 5,143,431 | A | | 9/1992 | Udell |

(Continued)

FOREIGN PATENT DOCUMENTS

| | | |
|---|---|---|
| EP | 0 069 668 A2 | 1/1983 |
| GB | 191320060 | 7/1914 |
| UA | 55326 U | 12/2010 |

*Primary Examiner* — Eugene L Kim
*Assistant Examiner* — Christopher Glenn
(74) *Attorney, Agent, or Firm* — Pauley Erickson & Swanson

(57) ABSTRACT

A target device for target practice. The target device is foldable from a planar cardboard material sheet into a three-dimensional housing having lifted target extensions. The target extensions can be formed or printed with a target shape, or a separate target label can be applied over the target extension. The target extensions can include a tab cut therein that can be folded outward to change the angle of the target extensions relative to the shooter user.

17 Claims, 3 Drawing Sheets

(56) References Cited

U.S. PATENT DOCUMENTS

| | | | | |
|---|---|---|---|---|
| 5,186,468 | A | 2/1993 | Davies | |
| 5,188,371 | A | 2/1993 | Edwards | |
| 5,275,890 | A | 1/1994 | Wolf et al. | |
| 5,501,467 | A | 3/1996 | Kandel | |
| 5,580,063 | A | 12/1996 | Edwards | |
| 5,853,336 | A * | 12/1998 | Hufgard | A63B 55/10 473/285 |
| 6,019,375 | A | 2/2000 | West, Jr. | |
| 8,444,056 | B2 | 5/2013 | Gamez et al. | |
| 8,545,226 | B2 | 10/2013 | Norden et al. | |
| 8,556,268 | B2 | 10/2013 | Su | |
| 8,596,643 | B1 | 12/2013 | Edwards | |
| 8,899,591 | B1 | 12/2014 | Donaldson | |
| 8,984,663 | B2 | 3/2015 | Lee et al. | |
| 9,170,077 | B2 | 10/2015 | Johnson et al. | |
| 9,234,726 | B2 | 1/2016 | Sharrock | |
| 2007/0046760 | A1 | 3/2007 | Zara | |
| 2008/0054570 | A1 | 3/2008 | Potterfield et al. | |
| 2009/0058008 | A1 | 3/2009 | Bamgartner et al. | |
| 2011/0107706 | A1* | 5/2011 | Fleishman | E04B 2/12 52/574 |
| 2011/0316234 | A1 | 12/2011 | Miller, Sr. | |
| 2014/0284880 | A1 | 9/2014 | Burks | |
| 2016/0327376 | A1 | 11/2016 | Flynn | |
| 2016/0327377 | A1 | 11/2016 | Flynn | |
| 2017/0248392 | A1 | 8/2017 | Flynn | |

* cited by examiner

MULTI-SIDED TARGET ASSEMBLY

CROSS REFERENCE TO RELATED APPLICATION

This application is a continuation of U.S. application Ser. No. 15/054,411, filed on 26 Feb. 2016. The co-pending parent application is hereby incorporated by reference herein in its entirety and is made a part hereof, including but not limited to those portions which specifically appear hereinafter.

FIELD OF THE INVENTION

This invention relates generally to a target for shooting practice, and, more particularly, to a target assembly that is foldable from a sheet of material into a three-dimensional target having target surfaces extending from each of a plurality of sides.

SUMMARY OF THE INVENTION

A general object of the invention is to provide an improved target structure for shooting. The target structure of this invention can include multiple sides with each side having one, and desirable more, target extensions that extend outward to serve as the shooting target. In embodiments of this invention, when the target extensions of one side are used for shooting, target extensions of a second side extend in a second, generally downward direction as legs supporting the target structure on a surface. The target extension 'legs' serve to raise and/or adjust an angle of the target structure. The target extensions can include tabs or other structures therein or thereon that allow adjustment of the angle of the target device, thereby allowing for angular adjustment of the target extensions for shooting.

A general object of the invention can be attained, at least in part, through a target device for practicing shooting that includes a target body having a first side adapted to fold at an angle to a second side, and a target extension cut in the first side and adapted to raise outward from the target body. Embodiments of this invention further include a target extension cut from the first side and extending flush from the second side outward from the target body and over a portion of the first side.

The target device of this invention can be folded from a planar material sheet, such as corrugated cardboard, precut to fold by a user. Embodiments of this invention include a target device for practicing shooting that comprises a planar material sheet having a first section, a second section and a third section. A first separation line extends across the planar material sheet and divides the first section from the second section. A second separation line extends across the planar material sheet and divides the second section from the third section. Each of the first and second separation lines includes a plurality of cuts in the material sheet defining target extensions, and a fold line extending between each of adjacent pairs of the plurality of cuts. The planar material sheet is adapted to fold about each of the first and second separation lines to form a target body that has at least two, and preferably at least three, sides each disposed at an angle to an adjacent side, and having the target extensions extending outward from the target body.

Other objects and advantages will be apparent to those skilled in the art from the following detailed description taken in conjunction with the appended claims and drawings.

DETAILED DESCRIPTION OF THE INVENTION

The present invention provides an apparatus for target practice or other shooting activity. The apparatus is a target device that can be formed as a planar material sheet that is precut to fold into a target device. The flat, foldable material sheet allows for efficient packaging for transport, retail sales, and/or storage. The target device is foldable to form a multi-sided target body that has one or more target extensions extending beyond the target body from one or more of the sides of the target body.

Figure 1:
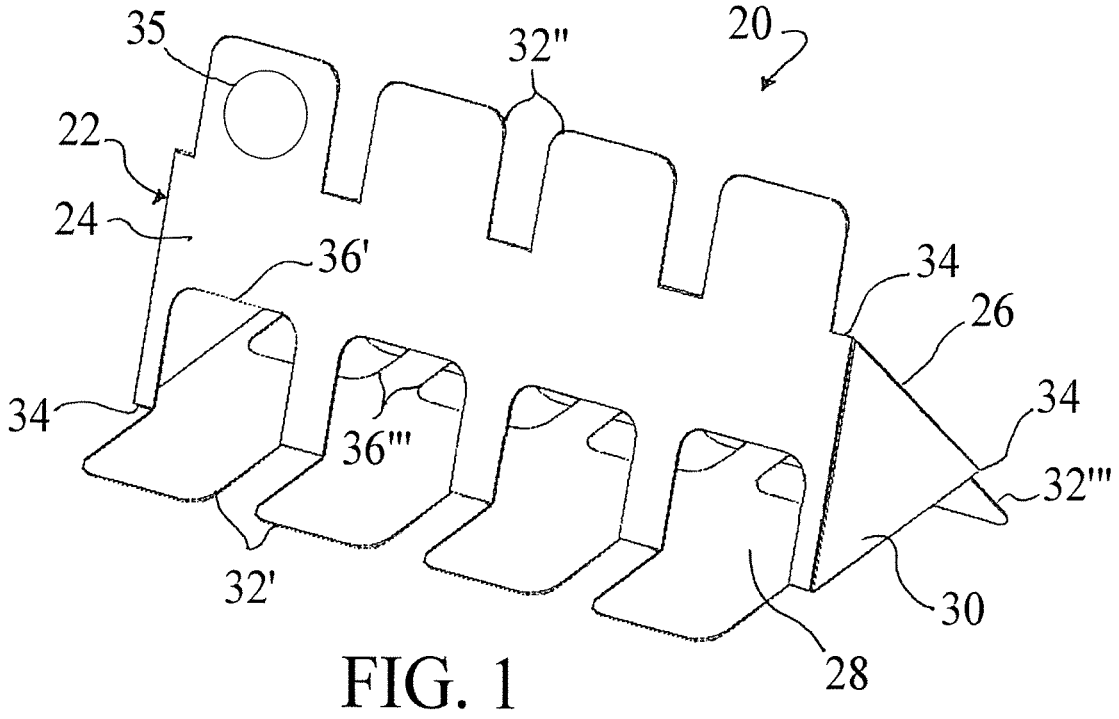
FIG. 1 shows a target device according to one embodiment of this invention.

FIG. 1 shows a target device 20 according to one embodiment of this invention for use in target shooting. The target device 20 includes a target body 22 having a first side 24 disposed at an angle with respect to a second side 26. The target device 20 further includes a third side 28 disposed at an angle with respect to, and extending between, each of the first side 24 and the second side 26. The target body 20 has a triangular tube shape with triangular shaped ends 30 and a hollow interior. Various and alternative sizes, shapes, and configurations are available for the target body, and its sides and ends, according to this invention, such as four or more sides.

The target device 20 includes a plurality of target extensions 32 that extend outward from the target body 22. In embodiments of this invention, as shown in FIG. 1, each of a plurality of spaced apart target extensions 32 extends from or beyond each edge 34 of the target body 22. Referring to FIG. 1, a first plurality of target extensions 32' is formed by a cut in the first surface 24, and when the target body is folded into the three-dimensional tube configuration each target extension 32' leaves a corresponding cutout 36' in the first surface 24. Each of the target extensions 32' is flush with, in a same plane as, or otherwise an extension of the third surface 28. Each of a second plurality of target extensions 32" is formed by a cut in the second surface 26, each leaving a corresponding cutout (not shown) in the second surface 26, and extending in a same plane as the first surface 24 outward over and/or at an angle to the corresponding cutouts. Each of a third plurality of target extensions 32" is formed by a cut in the third surface 28, each leaving a corresponding cutout 36" in the third surface 28, and extending in a same plane as the second surface 28 outward over and/or at an angle to the corresponding cutouts 36".

Figure 4:
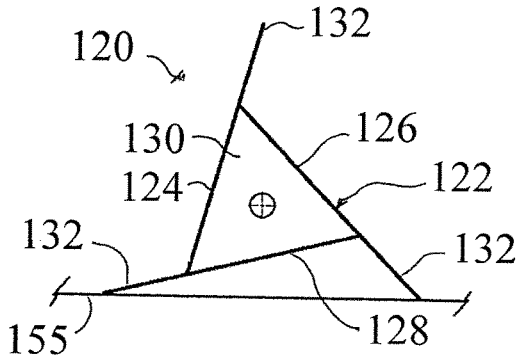

During use the target device 20 is placed upon a surface and the upwardly extending target extensions 32 are each useable as targets. The target extensions 32 can include a target display which can be shaped by the cutout and/or printed or drawn on the target extension. In embodiments of this invention, a separate target display can be attached to the target extension, such as, without limitation, clipped, pinned, or adhered to each target extension, such as by a self-adhesive target label 35 or sheet. As shown in FIG. 1 the upwardly extending target extensions 32" would be used for shooting. The target extensions 32' and 32''' act as legs to lift the target body 22 from a surface, as shown in FIG. 4. The target extension legs 32' and 32''' desirably adjust the angle of the upward target extensions 32'' toward the shooter, thereby creating a better line of sight.

The target device 20 is desirably formed of any suitable sheet material, such as a stiff paperboard material. Embodiments of this invention are formed from a corrugated cardboard or equivalent material. The target extensions can be reinforced as needed upon assembly and/or use. The target device can also be anchored by any of various mechanisms, such as anchoring pins or weights. As will be appreciated, various and alternative sizes, numbers, shapes, materials, and/or configurations are available for the target device and/or the target extensions according to embodiments of this invention, depending on need.

The target device of this invention can be manufactured and/or sold in the configuration shown in FIG. 1. In preferred embodiments of this invention, the target device is manufactured and/or sold in a flat, planar configuration that is assembled prior to use. The flat disassembled configuration provides for efficient transportation and storage, as well as ease of disposal after use.

Figure 2:
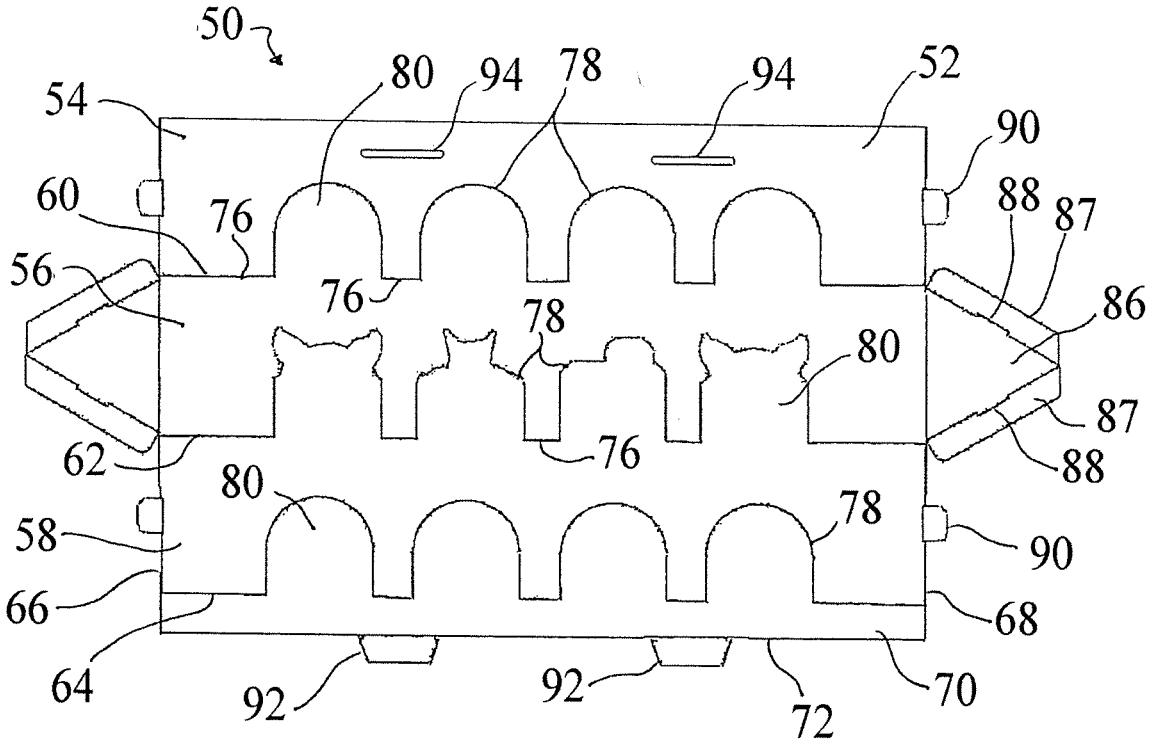
FIG. 2 shows a target device according to one embodiment of this invention in a planar, unfolded configuration.

FIG. 2 shows a target device 50 in a pre-assembled, planar or collapsed configuration according to one embodiment of this invention, and prior to folding and assembling into a non-planar use configuration similar to that shown in FIG. 1. A planar material sheet 52 includes a first section 54, a second section, 56, and a third section 58.

A first separation line 60 extends across the planar material sheet 50 from a first end 66 to a second end 68, and divides the first section 54 from the second section 56. A second separation line 62 extends across the planar material sheet 50 from the first end 66 to the second end 68, and divides the second section 56 from the third section 58. A third separation line 64 extends across the planar material sheet 50 from a first end 66 to a second end 68, and divides the third section 58 from a connection panel 70 at a side edge 72 that is opposite a second side edge 74 by the first section 54.

Each of the separation lines 60, 62, 64 forms one of parallel fold lines that allow the material sheet sections 54, 56, 58 to fold relative to each other to form sides of a target body, such as shown in FIG. 1. Each fold line has a linear fold path across the material sheet 52, and is formed by a plurality of aligned, discontinuous fold lines 76. The fold lines 76 can be real or imaginary, and are desirably embossed, perforated, or otherwise formed according to methods known in the art. When folded, the fold lines 76 will form the edges of the target body, such as described for FIG. 1.

Between each adjacent pair of fold lines 76 is a cut 78 in the material sheet 52 that defines a target extension 80. Each cut 78 extends, such as perpendicularly, out of the linear fold line path to form a target extension 80 that remains in plane or parallel with a corresponding one of the material sheet sections 54, 56, 58 upon folding to a use position similar to that shown in FIG. 1. The cuts 78 can be die cuts through the material sheet 52, or any suitable punch-out cut, such as perforations or kiss-cuts. The cuts 78 can follow any suitable path, to form target extensions 80 of any desired shape, such as the squared shape of FIG. 1, or the rounded and/or animal shapes shown in FIG. 2.

The planar material sheet 52 is foldable about each of the separation lines 60, 62, 64 to form a target body, similar to FIG. 1, having three sides each disposed at an angle to an adjacent side. Upon folding about the fold lines 76, the target extensions disengage at the corresponding cuts 78 and extend outward from the target body due to a lack of fold line extending across the base of each target extension 80. Similar to FIG. 1, each of the target extensions 80 will leave a corresponding cutout in the target body when the planar material sheet 52 is folded, and each of the target extensions 80 extends outward over and/or at an angle to the corresponding cutout.

The material sheet 52 of FIG. 2 includes optional end panels 86 attached, preferably by a fold line, to one of the sections 54, 56, 58, and having the same number of sides (3) as the number of sections. Each of the end panels 86 includes foldable flaps 87 that fold and insert within the target body, and include cut slots 88 at a fold line that are sized to accept a corresponding foldable tab 90 to secure the target body in the folded position. The connection panel 70 includes similar tabs 92 that fit within slots 94 in the first section 54 when folded. The connection panel 70 overlays the first section 54 when folded, and the target extensions 80 extending from the connection panel 70 are disposed abutting and parallel to the first section 54 in the folded configuration, and are in an adjacent, parallel plane instead of the exact same plane. Various sizes, shapes, configurations are available for the connection panel, tabs, and slots, depending on need. Alternatively, adhesive material or fasteners can be used to attach the sections, end panels, and/or connection panel in the folded configuration.

The target device illustrated is hollow but could alternatively be filled with a filler and/or weighting material. For example, a triangular foam body could be sized to fit within the target device, and reusable for additional target device. The target device can be anchored as needed by any suitable fastener or weight, such as a pin or stake through one or more of the downward extending target extensions and into the ground. The target body and/or target extensions can be provided with any suitable anchor openings through which the anchors can be fastened easily.

Figure 7:
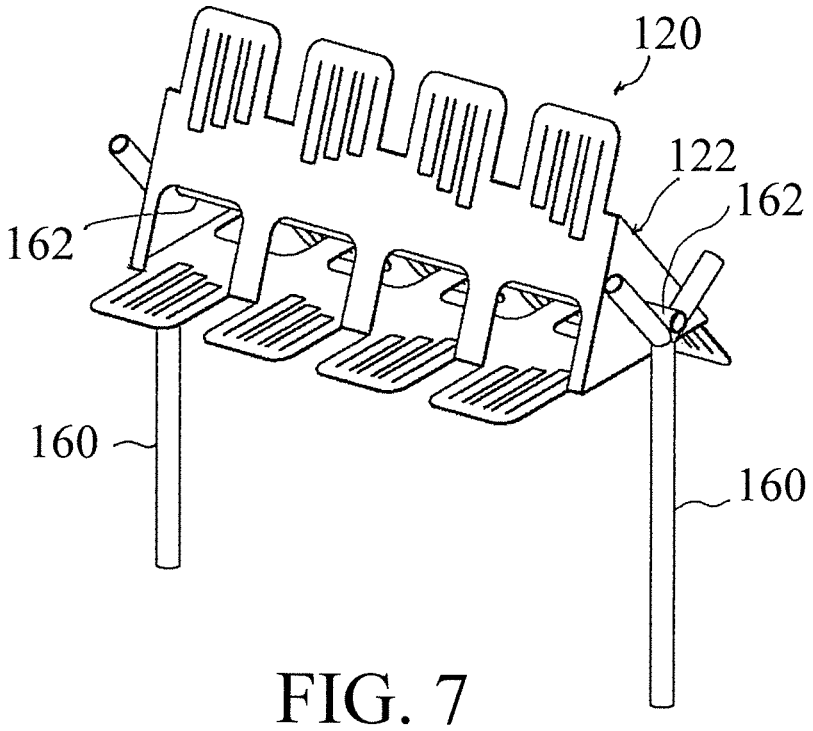
FIGS. 7-9 each illustrate a target device used in combination with one of various supporting structures for target use, according to embodiments of this invention.
Figure 8:
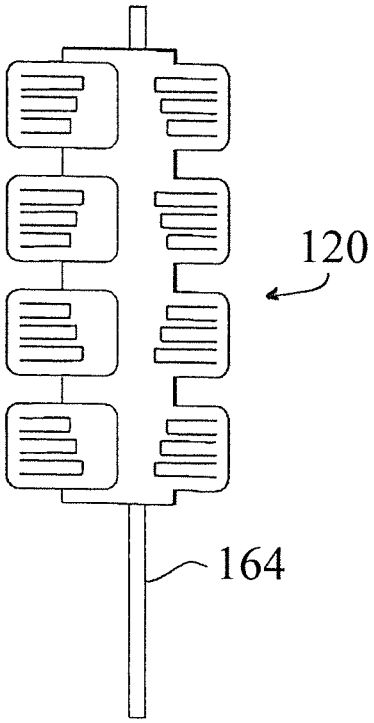
Figure 9:
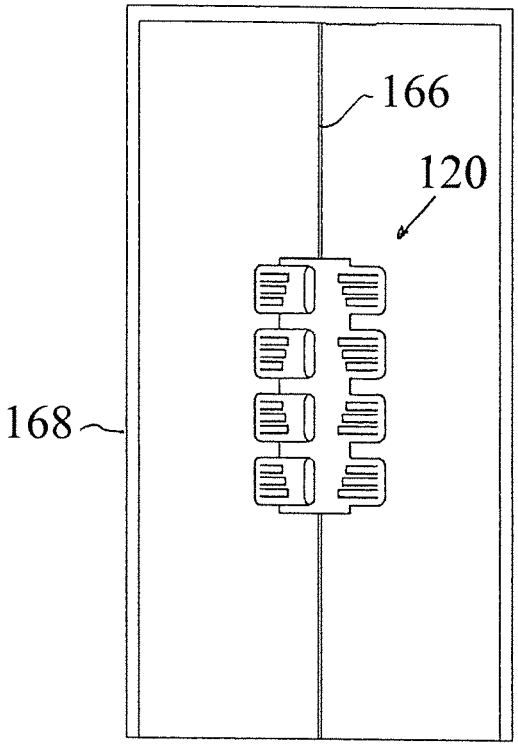

FIGS. 3-6 illustrate a target device 120 according to another embodiment of this invention. The target device 120 includes a target body 122 having a first side 124 disposed at an angle with respect to a second side 126, and a third side 128 disposed at an angle with respect to, and extending between, each of the first side 126 and the second side 128. The target body 120 is similar to the target 20 in FIG. 1, and also has a triangular tube shape with triangular shaped ends 130 and a hollow interior. The ends 130 each include a circular opening 135 or other suitable connection point, for use in anchoring and/or attaching to support structures, such as shown in FIGS. 7-9.

The target device 120 includes a plurality of target extensions 132 that extend outward from the target body 122. The target extensions 132 are similar to those described for FIG. 1, and additionally include an angle adjustment mechanism. The angle adjustment mechanism desirably adjusts the angular position of the target extension front surface 133 relative to shooter, such as to make the target more visible to the shooter's position.

Figure 3:
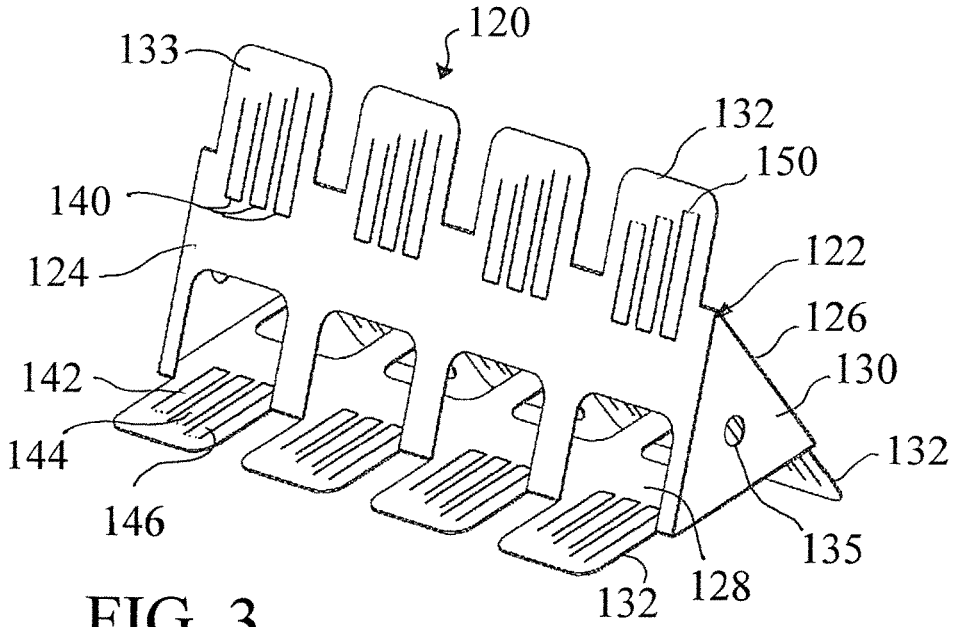
FIGS. 3-6 illustrate a target device according to another embodiment of this invention.
Figure 5:
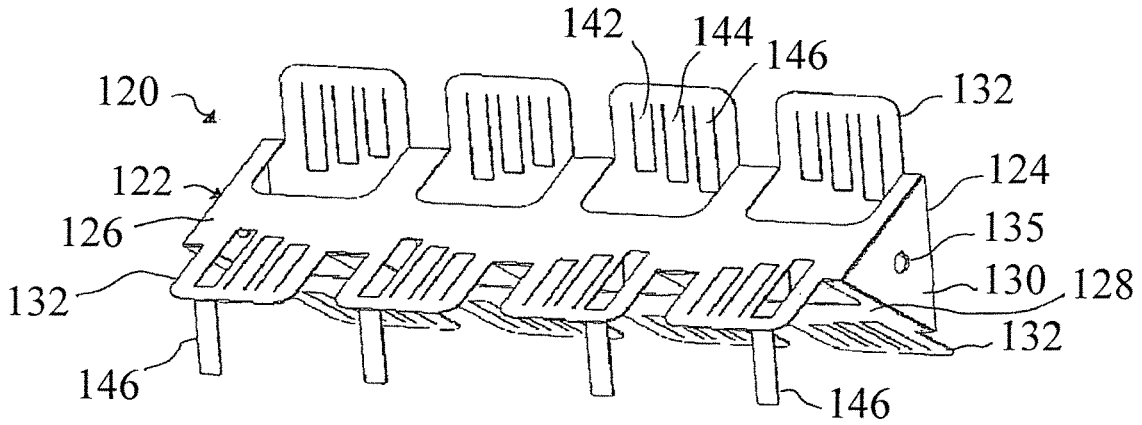

In embodiments of this invention, at least one, and desirably each of the target extensions includes at least one angle adjustment tab 140. As shown in FIGS. 3 and 5, each target extension 132 includes a plurality of angle adjustment tabs 140 cut into the target extension 132. In the embodiment of FIGS. 3 and 5, each target extension 132 includes more than one tab, namely tabs 142, 144 and 146. The tabs 142, 144 and 146 are each cut on three sides and include a real or imagined fold line 150 on a fourth side. Each of tabs 142, 144, and 146 is a different length, and when each is alternatively extended, provides a different angular adjustment as a result of the different length and having aligned fold lines 150. Applying a target label over the target extensions on face 133 will cover the tabs from sight during target use.

Figure 6:
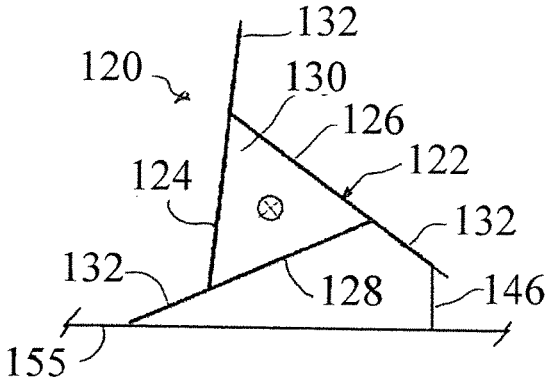

As shown in FIGS. 5 and 6, the folding about the fold line 150 extends the tab 146 outward at an angle to the target extension 132'''; the tab 146 then acting as a leg to raise the downward, backside target extension 132'''. The result is the change of angle in the upward target extension, as shown between FIGS. 4 and 6. In FIG. 6, the upward target extension 132'' is positioned at a smaller angle to a vertical axis from the horizontal surface 155. In embodiments of this invention, such as for the equilateral triangle profile shown in the figures, the angular position of the target extensions is adjustable at any desirable angle between about 60° to about 90° from the surface. If the tabs of the target extension 132' are raised with or instead of the tabs of the target extension 132''', the angle can be further adjusted, such as moving the face 133 a negative angle amount, further from the vertical. Various and alternative sizes, shapes, numbers, and configurations are available for the angle adjustment mechanism and/or angle adjustment tabs, depending on need. For example, the target extensions can be folded in half or set up on a separate or attached structure. The tabs can be reinforced as needed, such as by metal anchor stakes extending through a hole or slot, or pairs of holes/slots, cut in the tabs.

As shown in FIGS. 4 and 6, the target device of this invention can be set on the grounds or any suitable surface. The target device of embodiments of this invention can also be combined with suitable support structures, such as to suspend the target device off the ground. FIGS. 7-9 illustrate, without limitation, exemplary embodiments of this invention with the target device used in combination with various support structures. FIG. 7 shows target device 120 in a horizontal configuration between two vertical supports 160 on either side of the target device 120. A horizontal bar 162 extends through the opposing openings 135 and has ends that set in a Y-shaped top of the vertical supports 160. FIG. 8 shows the target device vertically positioned on a pole 164 that is anchored to the ground. FIG. 9 shows the target device hung by a string or cable 166 from a supporting structure 168. In each of these embodiments the target device can be easily rotated manually, if not by the force of the projectile impact.

Thus, the invention provides an inexpensive target device. The foldability of the target device prior to use allows for efficient storage and transport. The target device provides multiple target extensions and multiple target use per device. Modifications can be easily made due to the cardboard material sheet construction.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A target device for practicing shooting, the target device comprising:

a planar material sheet having a first section and a second section;

a separation line extending across the planar material sheet and dividing the first section from the second section, wherein the first section is adapted to fold about the separation line at an angle to the second section;

the separation line comprising a plurality of cuts in the material sheet and a fold line extending between and connecting each of adjacent pairs of the plurality of cuts, wherein each of the plurality of cuts in the material sheet defines one of a plurality of target extensions, the each of the plurality of cuts extends from the fold line in a direction toward the first section, each of the target extensions extends outward at and from the fold line when folded, each of the target extensions extends from the second section over the first section in a raised position, and the each of the target extensions is individually a shooting target; and a second separation line extending across the planar material sheet and dividing the second section from a third section.

2. The target device of claim 1, wherein each of the target extensions is substantially parallel in a same plane with the second section in a raised position.

3. A target device for practicing shooting, the target device comprising:

a planar material sheet having a first section and a second section;

a separation line extending across the planar material sheet and dividing the first section from the second section, wherein the first section is adapted to fold about the separation line at an angle to the second section;

the separation line comprising a plurality of cuts in the material sheet and a fold line extending between and connecting each of adjacent pairs of the plurality of cuts, wherein each of the plurality of cuts in the material sheet defines one of a plurality of target extensions, the each of the plurality of cuts extends from the fold line in a direction toward the first section, each of the target extensions extends outward at and from the fold line when folded, each of the target extensions extends from the second section over the first section in a raised position, and the each of the target extensions is individually a shooting target; and a second plurality of target extensions cut in the second section and adapted to raise outward from a target body about a folded second separation line that is parallel to the separation line.

4. A target device for practicing shooting, the target device comprising:

a planar material sheet having a first section and a second section;

a separation line extending across the planar material sheet and dividing the first section from the second section, wherein the first section is adapted to fold about the separation line at an angle to the second section;

the separation line comprising a plurality of cuts in the material sheet and a fold line extending between and connecting each of adjacent pairs of the plurality of cuts, wherein each of the plurality of cuts in the material sheet defines one of a plurality of target extensions, the each of the plurality of cuts extends from the fold line in a direction toward the first section, each of the target extensions extends outward at and from the fold line when folded, each of the target extensions extends from the second section over the first section in a raised position, and the each of the target extensions is individually a shooting target, wherein the target device is formed of corrugated cardboard.

5. The target device of claim 4, further comprising a self-adhesive paper target adapted to adhere parallel to, and cover at least a portion of, the target extension.

6. The target device of claim 4, wherein the fold line is discontinuous across the planar material sheet, and divided into fold line sections by the plurality of cuts.

7. A target device for practicing shooting, the target device comprising:

a target body having a first side folded at an angle to a second side to stand the target device upright for the practicing shooting;

a plurality of target extensions cut out from the first side and each extending flush from the second side outward from the target body and over a portion of the first side; and a plurality of self-adhesive paper targets each adhered over at least a portion of a corresponding one of the plurality of target extensions.

8. The target device of claim 7, further comprising a fold line connecting and separating the first side and the second side, wherein the target extension extends outward from the fold line when folded.

9. The target device of claim 7, further comprising a cutout in the first side corresponding to the target extension.

10. The target device of claim 7, further comprising a plurality of fold lines each extending between and connecting an adjacent pair of the plurality of target extensions, the fold lines connecting and separating the first side and the second side.

11. The target device of claim 7, further comprising a third side folded at an angle to a second side to form a target body, and a second plurality of target extensions cut out from the second side and each extending flush from the third side outward from the target body and over a portion of the second side.

12. The target device of claim 11, further comprising a fold line connecting and separating the third side and the second side, wherein the second plurality of target extensions extend outward from the fold line when folded.

13. The target device of claim 7, wherein the angle is 60°.

14. A target device for practicing shooting, the target device comprising:

a planar material sheet having a first section, a second section and a third section;

a first separation line extending across the planar material sheet and dividing the first section from the second section;

a second separation line extending across the planar material sheet and dividing the second section from the third section;

each of the first and second separation lines comprising a plurality of cuts in the material sheet and a fold line extending between and connecting each of adjacent pairs of the plurality of cuts, wherein the plurality of cuts in the material sheet define target extensions;

wherein the planar material sheet is adapted to fold about each of the first and second separation lines to form a target body from the first section, the second section and the third section, and such that each of the target extensions extend outward from one of the folded first and second separation lines, and a first of the target extensions extends from and flush with the second section, and a second of the target extensions extends from and flush with the third section.

15. The target device of claim 14, wherein each of the target extensions leaves a corresponding cutout in the target body when the planar material sheet is folded, and the each of the target extensions extends outward over the corresponding cutout.

16. The target device of claim 14, wherein the planar material sheet comprises a first end and a second end, the first section is at the first end, and further comprising a connection panel at the second end, wherein the connection panel attaches to the first section in a folded configuration.

17. The target device of claim 14, wherein at least one of the target extensions comprises a tab cut therein, wherein the tab is foldable outward at an angle to the target extension.

* * * * *